US011047068B2

(12) United States Patent
Ezer

(10) Patent No.: US 11,047,068 B2
(45) Date of Patent: Jun. 29, 2021

(54) VARIABLE COLOR OR TEXTURE EXPRESSION KNITTING, WEAVING, AND LAMINATING SYSTEM, METHOD AND FABRIC

(71) Applicant: Ezer Vision L.L.C., Antigo, WI (US)

(72) Inventor: Zoltan Ezer, Antigo, WI (US)

( * ) Notice: Subject to any disclaimer, the term of this patent is extended or adjusted under 35 U.S.C. 154(b) by 307 days.

(21) Appl. No.: 15/911,091

(22) Filed: Mar. 3, 2018

(65) Prior Publication Data

US 2018/0251917 A1 Sep. 6, 2018

Related U.S. Application Data

(60) Provisional application No. 62/466,519, filed on Mar. 3, 2017.

(51) Int. Cl.

| | |
|---|---|
| ***D02G 1/02*** | (2006.01) |
| ***D04B 1/14*** | (2006.01) |
| ***D04B 21/14*** | (2006.01) |
| ***D04H 3/04*** | (2012.01) |
| ***D03D 13/00*** | (2006.01) |
| ***D04B 21/16*** | (2006.01) |
| ***D04B 35/22*** | (2006.01) |
| ***D02G 3/00*** | (2006.01) |
| ***D03D 15/47*** | (2021.01) |
| ***D03D 15/54*** | (2021.01) |
| ***D03D 15/46*** | (2021.01) |

(52) U.S. Cl.

CPC ..... *D02G 1/0286* (2013.01); *D02G 3/00* (2013.01); *D03D 13/00* (2013.01); *D03D 15/47* (2021.01); *D03D 15/54* (2021.01); *D04B 1/14* (2013.01); *D04B 21/14* (2013.01); *D04B 21/16* (2013.01); *D04B 35/22* (2013.01); *D04H 3/04* (2013.01); *D03D 15/46* (2021.01); *D10B 2401/20* (2013.01); *D10B 2403/011* (2013.01)

(58) Field of Classification Search

USPC ..... 139/426 R; 700/131, 139; 442/301

See application file for complete search history.

(56) References Cited

U.S. PATENT DOCUMENTS

| | | | |
|---|---|---|---|
| 4,756,342 | A | 7/1988 | Van Bogaert |
| 5,727,439 | A | 3/1998 | Pecl |
| 5,901,544 | A | 5/1999 | McNeill |

(Continued)

FOREIGN PATENT DOCUMENTS

| | | | |
|---|---|---|---|
| AU | 2003257222 | A1 | 3/2004 |
| CH | 582097 | A5 | 11/1976 |

(Continued)

OTHER PUBLICATIONS

International Search Report and Written Opinion of the International Searching Authority dated May 2, 2018, for PCT Application No. PCT/US18/20809 filed Mar. 3, 2018, 10 pages.

*Primary Examiner* — Lynda Salvatore

(74) *Attorney, Agent, or Firm* — Boardman & Clark LLP

(57) ABSTRACT

Disclosed is a method of producing a variable-color textile, the method comprising: providing a plurality of filaments into a commercial textile-production machine, the plurality filaments having at least a first color and a second color; and twisting at least one of the plurality of filaments to display a first color on a first side of a fabric surface and a second color on an opposite side of the fabric surface.

17 Claims, 12 Drawing Sheets

(56) References Cited

U.S. PATENT DOCUMENTS

| | | | | |
|---|---|---|---|---|
| 6,045,923 | A | 4/2000 | Kok et al. | |
| 6,274,519 | B1 | 8/2001 | Omori et al. | |
| 6,865,439 | B1 * | 3/2005 | Tu | D04B 37/00 700/131 |
| 7,318,456 | B2 | 1/2008 | Nayfeh et al. | |
| 8,316,672 | B2 | 11/2012 | Karatzis | |
| 8,381,773 | B2 | 2/2013 | Sho et al. | |
| 8,784,969 | B2 | 7/2014 | Landertshamer | |
| 2005/0161105 | A1 * | 7/2005 | Tseng | D02G 3/045 139/426 R |
| 2007/0089799 | A1 | 4/2007 | Zorini | |
| 2009/0123095 | A1 * | 5/2009 | Welch | D04C 1/12 383/117 |
| 2011/0093220 | A1 | 4/2011 | Yang | |

FOREIGN PATENT DOCUMENTS

| | | | |
|---|---|---|---|
| DE | 4037738 | A1 | 6/1991 |
| DE | 29708146 | U1 | 6/1997 |
| DE | 10159971 | A1 | 6/2002 |
| DE | 102006004681 | A1 | 8/2007 |
| EP | 0384613 | A1 | 8/1990 |
| EP | 0891698 | A2 | 1/1999 |
| EP | 2607532 | A1 | 6/2013 |
| WO | 1994024510 | A1 | 10/1994 |
| WO | 2004020721 | A1 | 3/2004 |
| WO | 2007140801 | A1 | 12/2007 |
| WO | 2010081179 | A2 | 7/2010 |

* cited by examiner

VARIABLE COLOR OR TEXTURE EXPRESSION KNITTING, WEAVING, AND LAMINATING SYSTEM, METHOD AND FABRIC

CROSS-REFERENCE TO RELATED APPLICATIONS

This application claims priority to U.S. Provisional Patent Application No. 62/466,519 filed Mar. 3, 2017, the entirety of which is incorporated by reference.

FIELD

The present inventions relate to the field of textile production. The present inventions more specifically relate to the field of multiple color or texture expression for industrial textile fabrics and production and systems therefore.

BACKGROUND

Production of industrial textiles is typically performed on a variety of devices, including weaving, laminating, and knitting machines. These machines are provided with fibers or filaments comprised of, for example, plastic, synthetic, organic, or manmade materials. The fibers or filaments are typically wound into a single yarn or tape provided about a spool. The spool ultimately feeds into a feeder or guiding bar, which is used to create knit, woven, laminate, or other suitable material. Of difficulty, however, is a creating commercial material having multiple colors using single warp or weft or both having means to produce a controlled or random pattern.

Mechanisms for creating a patterned or multi-colored textile have been produced; for example, using a Jacquard weaving or Jacquard knitting machine (as disclosed in, for example DE 10200604681 A1) or an embroidery machine having multiple needles and guides. In addition, tatting methods can provide for multiple colors, however, not in the context of industrial applications. Similarly, thread or yarn which has been dyed multiple colors can be used to create a fabric having those particular colors. In addition, multi-filament thread may contain multiple colors.

In addition, some textiles are printed with patterns or colors. For example, textiles may be printed digitally. This may be very costly in terms of ink and setup; printing also has disadvantages regarding repeats of patterns (patterns may not be truly random). Printing is also typically only provided on one side of the fabric.

Each of these solutions suffers from various drawbacks. For example, the Jacquard machines take a significant amount of time to set up and are quite complicated, due to requiring more needles and guides. As a result, Jacquard textiles are expensive to produce. Similarly, embroidery, tatting, and non-industrial means likewise take more time to produce the controlled-color fabric.

Multi-dyed threads and multi-filament threads can introduce multiple colors; however, the product produced does not have truly random expression of colors. In the instance of a multi-dyed thread, the color expression appears wherever the portion of thread has the particular color. In the circumstance of multi-filament threads (for instance, to create a "heathered" fabric using two opposite thread colors), the color expression is likewise not truly random and not individually expressive of color as the colors blend, for example, black and white become grey. Likewise, these techniques are traditionally not used in industrial textile production. In addition, apparatuses cannot be incorporated with these threads to produce controlled expression of the colors in particular circumstances.

Multiple color textiles may be achieved with an industrial application, however, this typically requires re-threading of the line with a new strand of yarn having the new color. This may be accomplished through multiple weft thread switching means (for example, as disclosed in U.S. App. No. 2007/0089799); or modular systems (such as the method disclosed in U.S. Pat. No. 7,318,456). Like the Jacquard process, re-threading takes additional time and resources.

Therefore, what is needed is an efficient, effective, and elegant way to provide multiple colors using multiple tapes or filaments for known industrial fabric-making machines.

SUMMARY

Accordingly, a method and device for producing a fabric having multiple colors or textures is disclosed. The fabric may allow for substantially random expression of a pattern on the surface of a fabric. The expression may be on both sides of a fabric.

In one embodiment of the method and fabric, a plurality of different colored filaments of sufficient width to effectively display their distinct colors when positioned on the surface of a fabric can be directed as a composite warp or weft or both through a single guide or needle such that as the composite filament(s) is engaged and redirected by the tools of the machine in the fabricating process each of the combined filaments will be randomly presented to the surfaces of each side of the fabric to display its color in a repeated manner. Alternatively, in another embodiment of the method and one or more fabric one or more coextruded tapes having two sides of different colors can be directed as a warp or weft or both through a single guide or needle such that as the two colored type of multi-colored tapes are repeatedly engaged and redirected by the tools of the machine, each of the colors will be randomly displayed on both sides of the resulting fabric.

Alternatively, in another embodiment, the device may include a twisting mechanism for accepting multiple (but limited number of) filaments, threads, yarns, or tapes ("yarns or tapes") which are first separated, then collected, then twisted, and then sent to a feeder or guide to induce expression of a corresponding color or texture in the fabric. The fabric may be knit, woven, laminated, or produced by any other known fabric production means, whereby the twisting produces the expression of the color or texture in a variety of patterns.

Twisting may be done by a non-controlled twister, which twists a group of yarns or tapes at random. When the twisting is performed by non-controlled system using the twister, a truly random color or texture expression may be achieved. Also disclosed is a mechanism or system for automating the twisting of the yarns or tapes. In various embodiments, the automated mechanism or system may constitute a servo-driven twister which engages the filaments and uses rotation to perform the twist, thereby inducing the desired color or texture expression.

In various embodiments, the system or method includes a programmable logic component which interacts with the servo in order to program expression of the color or texture. The textile production system may therefore include a computer having the instructions which then send a signal at designated times to the servo to produce a pattern, image, or even a purely random expression of color or texture.

Disclosed is a method of producing a variable-color textile, the method comprising: providing a plurality of filaments into a commercial textile-production machine, the plurality filaments having at least a first color and a second color; twisting at least one of the plurality of filaments to display a first color on a first side of a fabric surface and a second color on an opposite side of the fabric surface. Further disclosed is a method of producing a variable-color textile comprising twisting at least two of the plurality of filaments to display a first color on a first side of a fabric surface and a second color on an opposite side of the fabric surface. Further disclosed is a method of producing a variable-color textile wherein the one of the plurality of filaments is a single filament having the first color on a first side of the filament and the second color on the second side of the filament. Further disclosed is a method of producing a variable-color textile wherein the plurality of filaments are tapes of extruded film. Further disclosed is a method of producing a variable-color textile wherein the at least one of the tapes of extruded film has a first color provided on a first side and a second color provided on a second side. Further disclosed is a method of producing a variable-color textile wherein the plurality of filaments comprises at least three filaments, each having a different color, whereby three different colors will be randomly displayed on each side of a fabric. Further disclosed is a method of producing a variable-color textile wherein the twisting is performed by a twister. Further disclosed is a method of producing a variable-color textile wherein the twister is controlled by a computer.

Disclosed is a fabric having a surface comprising one or more filaments having a plurality of twists, the one or more filaments having a first color presented on a first side of the fabric surface by a first side of a twist and a second color presented on an opposite side of the fabric by a second side of the twist. Further disclosed is a fabric wherein the one or more filaments are twisted multiple times along its length to repeatedly and intermittently present the first color and second color on the opposed surfaces of the fabric along the length of said at least one of such filaments. Further disclosed is a fabric wherein at least one filament of the plurality of filaments is an extruded film. Further disclosed is a fabric wherein the first color is on a first side of the extruded film and the second color is on a second side of the extruded film opposite the first side. Further disclosed is a fabric wherein the plurality of filaments is comprised of three filaments of different colors and is twisted multiple times along its length wherein the three colors are randomly, repeatedly, and intermittently presented on each of the opposed surfaces of the fabric. Further disclosed is a fabric wherein the plurality of filaments is comprised of at least four filaments of different colors and is twisted multiple times along its length wherein the four colors are repeatedly and intermittently presented on each of the opposite surfaces of the fabric. Further disclosed is a fabric wherein the twists are produced by a twister. Further disclosed is a fabric wherein the tapes are two-sided with different colors on opposite sides of the tapes. Further disclosed is a fabric wherein the fabric is selected from the group of knitted, woven, or laminated.

A fabric comprised of a plurality of filaments of different colors, such fabric having been produced by a commercial machine-fed process including the step of continuously feeding a warp and/or weft with said plurality of said filaments of different colors to a said fabricating machine, and whereby the plurality of said filaments feeding at least said warp and/or weft are repeatedly mechanically twisted to present multi-colored fabric sides with repeated and intermittent presentation of the various colors of the filaments. Further disclosed is a fabric wherein the filaments comprise extruded film. Further disclosed is a fabric wherein the first color is on a first side of the extruded film and the second color is on a second side of the extruded film opposite the first side.

BRIEF DESCRIPTION OF DRAWINGS

Various examples of embodiments of the systems, devices, and methods according to this invention will be described in detail, with reference to the following figures, wherein.

It should be understood that the drawings are not necessarily to scale. In certain instances, details that are not necessary to the understanding of the invention or render other details difficult to perceive may have been omitted. It should be understood, of course, that the invention is not necessarily limited to the particular embodiments illustrated herein.

DETAILED DESCRIPTION

Referring to the Figures, a system and method for producing a fabric having multiple color or texture expression is disclosed. The system and method according to one or more examples of embodiments includes providing multiple filaments in a traditional industrial fabric production system which are then twisted in order to produce expression of a desired color or texture. This system, method, and device can be used or integrated with a number of types of textile machines configured to produce knit, laminated, or woven materials, such as, but not limited to, Raschel machines (knit), applicator (laminated), or looms (woven). An example of a Raschel machine can be seen in U.S. Pat. No. 3,523,431. An example of an applicator machine can be seen in U.S. Pat. No. 3,276,938. These are merely given as example types of machines, and the present disclosure should not be construed to be limited to these particular example machines.

Figure 1:
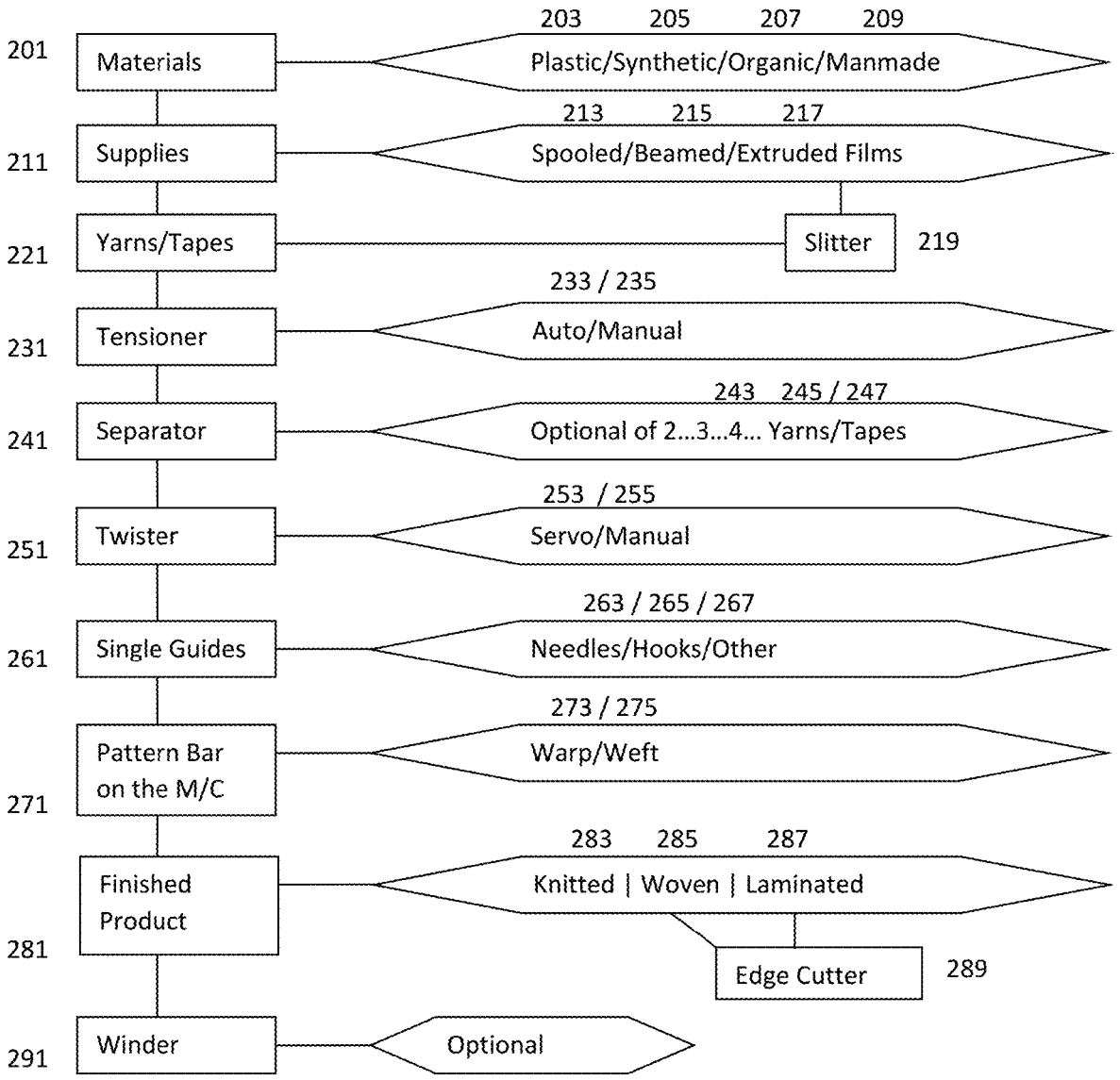
FIG. 1 illustrates a flowchart for production of textiles using the system and method disclosed herein, according to various embodiments.

Turning to FIG. 1, a flowchart is provided detailing the system and method for multiple color or texture expression in a variety of fabric production devices. First, materials 201 are provided to the machine 105. In various embodiments, the materials are plastic 203, synthetic 205, organic 207, manmade 209, or any other suitable material. These materials are supplied 111 to the system using spooled 213, beamed 215, or extruded films 217. If an extruded film 217 is provided, the films are slit 219 before proceeding to the next step which turns the supply into yarns or tapes 221 for use by the system. The appropriate yarns or tapes 221, sometimes referred to herein as filaments 103, are provided to a tensioner 231, which can be automatic 233 or manual 235. Next the yarns or tapes 221 (filaments 103) are provided to a separator 241, which can separate the yarns or tapes into groups of two, three, four, or any suitable division 243. In various embodiments, the spool 112 or beams 114 may house three or four grouped yarns or tapes 221 (filaments 103), thereby bypassing the separator 241.

Continuing with FIG. 1, in various embodiments, the yarns or tapes are then provided to a twisting mechanism, or "twister" 251. The twister 251 may be automated or non-controlled. If the twister is non-controlled, the twister may directly twist the group of yarns or tapes to express a certain color in the fabric without any instructions. The non-controlled twisting may optionally be inherent to the functioning of a commercial textile-production machine 105. If automated, the twisting may be performed by a servo 253 or other suitable control device. The servo 253 or other suitable device may then be controlled by a programmable logic component which instructs the servo to twist according to a program. Alternatively, the twisting may be manually 255 controlled by a twister 251. Any twister mechanism capable of twisting the multiple yarns or tapes to selectively expose a one or two of the different color or texture filaments on a side of the fabric for a selected distance within the surface of the fabric side. Such distance may be short and pixel-like or longer as shown in the examples of FIGS. 4A-9.

The twisted group of tapes or yarns 245, 247 may then be fed to a single guide 261, which may take the form of needles 263, hooks 265, or other appropriate means 267. Next, a single thread line comprised of the group of yarns or tapes 245, 247 (filaments 103) may be fed by a single guide 261 to a pattern bar 271 on the machine, whether used on the warp 273 or weft 275 side. The relevant weaving, knitting, or laminated machine (e.g. commercial textile-production machine 105) then proceeds to weave, knit, or laminate the provided group of yarns or tapes. The finished product 281 is then a knitted 283, woven 285, or laminated 287 product comprised of the selectively twisted yarns or tapes to express the colors or textures in a desired random or predetermined pattern. If woven or laminated, the fabric may undergo edge trimming 289, winding, or cutting. The fabric likewise may be wound by a winder 291.

Figure 2:
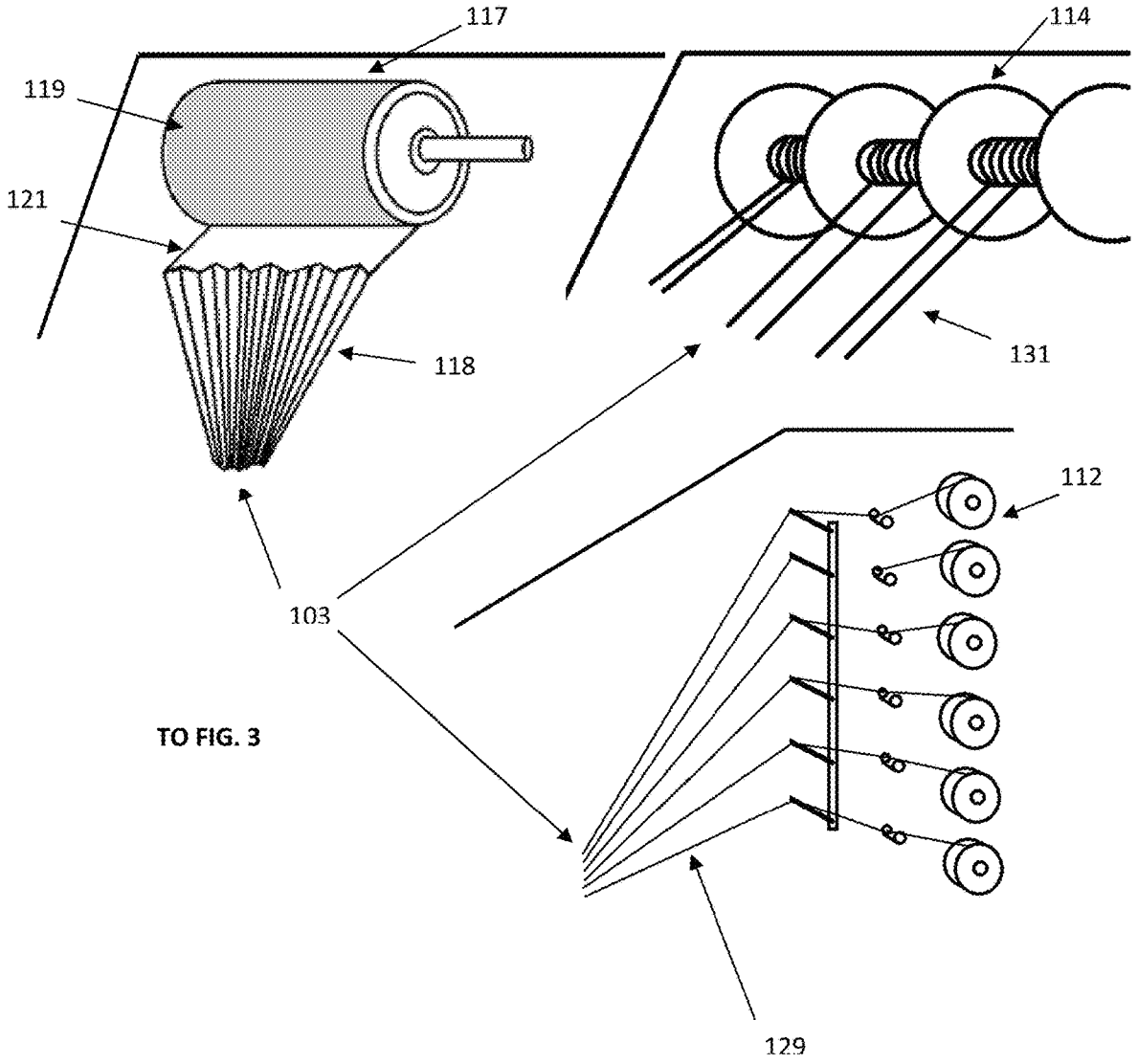
FIG. 2 illustrates the optional supplies used for production of textiles using the system and method disclosed herein, according to various embodiments.

FIG. 2 discloses the materials to be used to produce the textiles (fabric) 101 in a visual mode. The film 117, beam 114, and spools 122 supply the yarns 129 or tapes 131 (filaments 103) to the system further disclosed in FIGS. 3A and 3B. The film 117 may comprise a dual-extruded (or coextruded) laminar film having a first side 119 and second side 112 such that two different colors are respectively provided on opposite sides of each tape/film 118. In various embodiments, the film 117 is a coextruded film. The coextruded film may comprise three sheets: a first sheet having a first color expressed on a first side 119, a second sheet having a color expressed on a second side 121, and a third sheet having a third color provided in between the two sides (slitting the coextruded film allows for a filament having a first side having a first color 119 and a second side having a second color 121 opposite the first filament side). In various embodiments, the first and second sheets may be approximately 10-20 microns in thickness, and more specifically approximately 14-16 microns in thickness, while the center sheet may be thicker, for example, 40-60 microns or more specifically 50-55 microns in thickness. The entire coextruded film may be approximately 50-100 microns in thickness or more specifically 75-85 microns in thickness. While the film 117 may be initially extruded to be a thicker filament, the film after slitting may be stretched to a much thinner thickness. In FIG. 2, numbers II-III, it should be noted that multiple colors or material types can be provided for twisting. The filaments 103 (films 118, yarns 129, tapes 131, etc.) may be comprised of a variety of materials 201 including plastic 203 synthetic 205 or organic 207 materials or fibers. In various embodiments, the materials may include HDPE, polypropylene, elastic, spandex, etc.

Figure 3A:
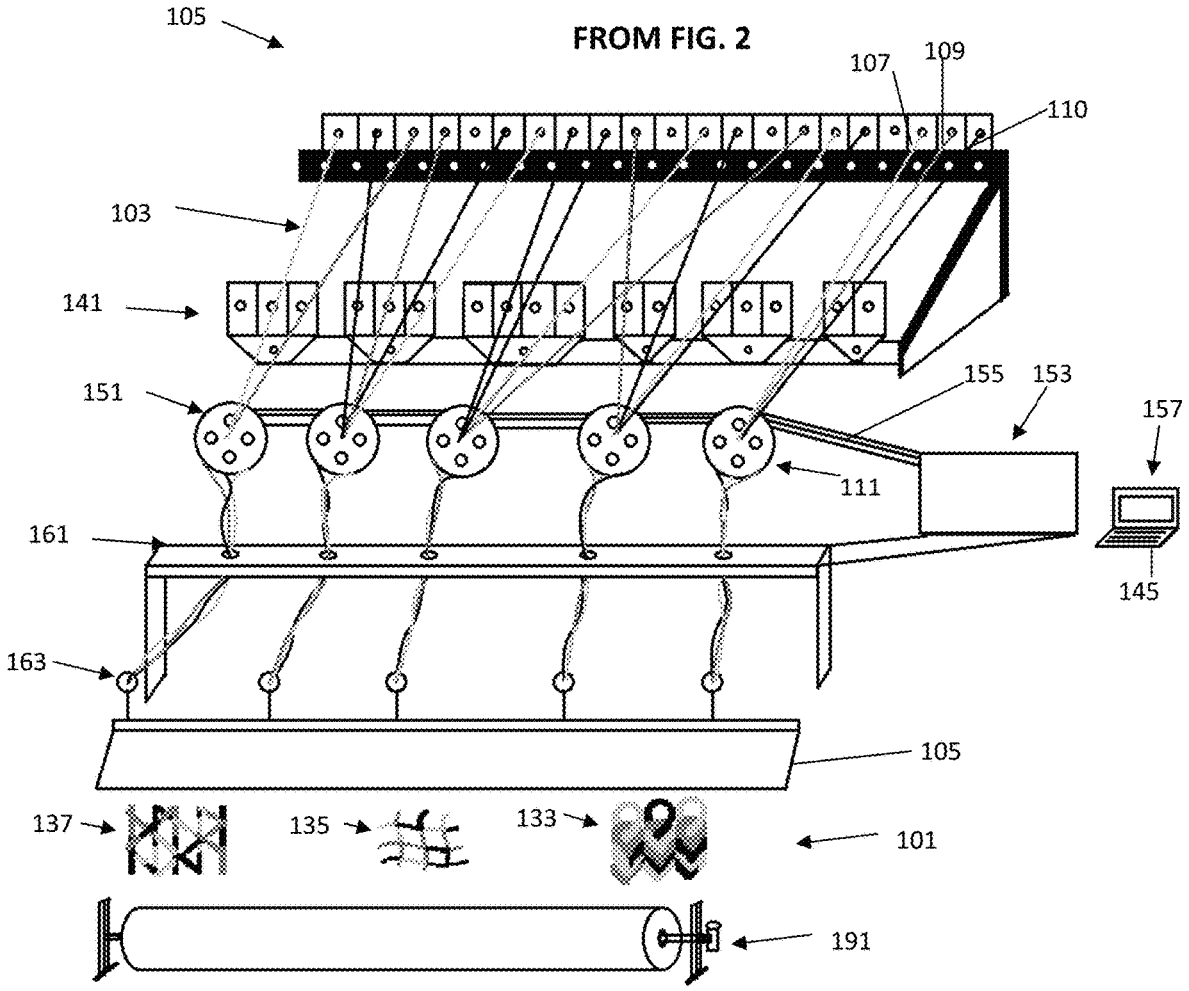
FIG. 3A illustrates a first set of components and system for production of textiles using the system and method disclosed herein, according to various embodiments.
Figure 3B:
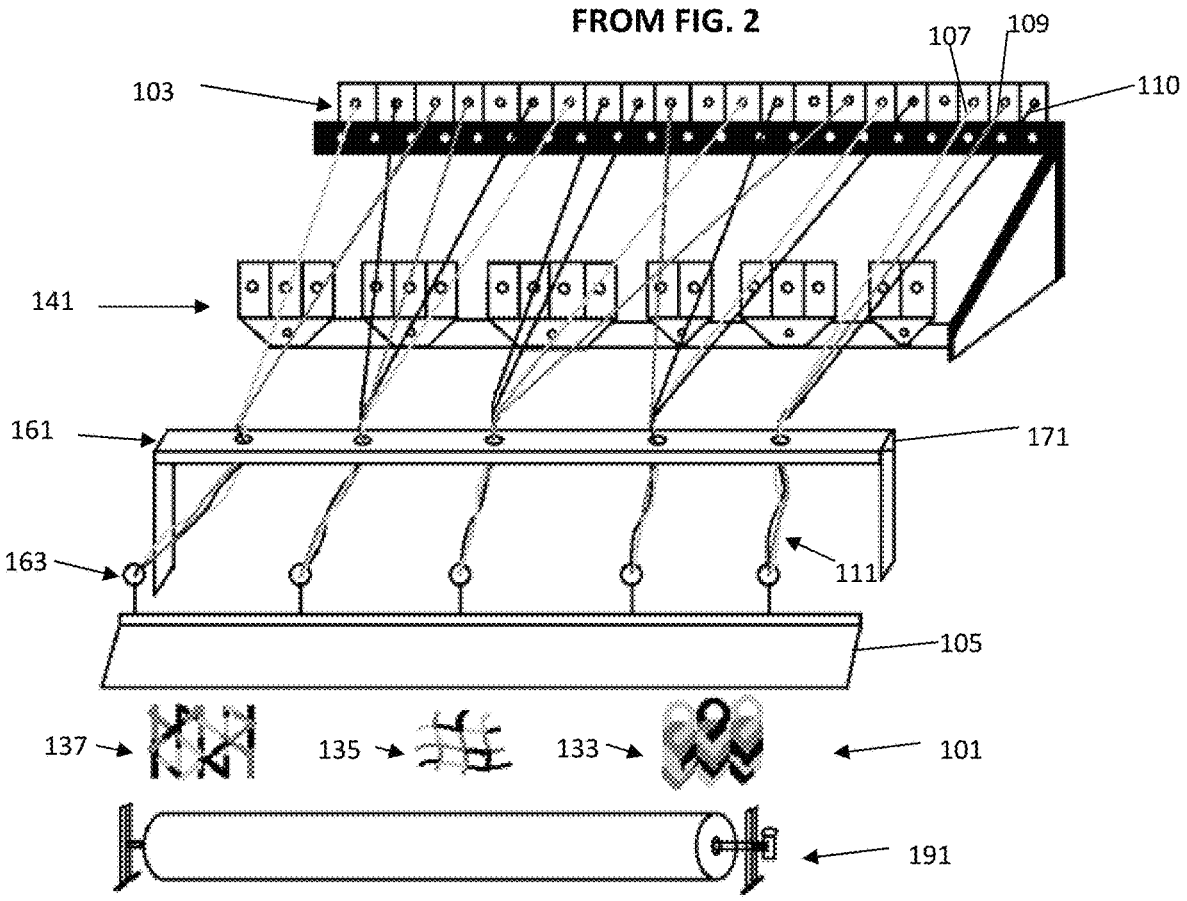
FIG. 3B illustrates a second set of components and system for production of textiles using the system and method disclosed herein, according to various embodiments.

FIGS. 3A-3B show the components and system for production, including not only operation but also machine set up. Each of the knitting, weaving, and laminator machines have different setups, which are based on their machine types and products. In order to produce fabric (textile) 101 (It should be understood the schematic representation having reference number 101 in FIGS. 3A and 3B is intended to show the resulting textile production wherein the color expression is the result of twisting the group of filaments 103 based on the disclosed system or method. The setup varies (compare, for example, FIG. 3A and FIG. 3B) to provide the twisting functionality. For example, a twister 151 may be freestanding, attached to a servo 153, connected to a computer 145, or physically attached on the machine 105.

Continuing with FIG. 3A, the twister 151 is shown located before the feeder or guiding bar 161 which are directly attached to all three commercial textile-production machine types 105 (i.e. knitting, weaving, laminating). The machines may comprise typical tools used for the process of looping, weaving, or positioning for lamination the yarns or tapes to form the finished product. The twisting mechanism 151 may be located after the separator 141 which keeps the films 118, yarns 129 or tapes 131 (filaments 103) separated from one another but collects the specific color or type of filaments 103 for the twister 151. It should be noted, however, that a separator 141 is not the only means for grouping the yarns or tapes; the groups of yarns or tapes may be provided from the beam 114 or spools 112, for example. The filaments 103 may be provided in a number of colors (first color 107, second color 109, third color 110). They may individually comprise a single color or multiple colors (for example an extruded film having a filament first side with a first color 119 and a filament second side having a second color 121).

The twisting 111 of the filaments 103 (whether effected by way of a twister 151, other intervention, or through normal operation of the industrial textile machine) should be understood to allow for intermittent expression of certain colors. For example, if three colors are provided on the filaments, the twisting allows for intermittent and, in various embodiments, random expression of three colors. While three colors are provided as an example, two, four, five, six, etc. should be understood as within the scope of this disclosure.

As shown in FIG. 3A, several twisters 151 may be provided in the system. These twisters 151 are separated from each other and twist the given colored or textured filaments 103 which are continually moving from the separators 141. By twisting the different colored or textured yarns or tapes (filaments 103) which are (but not necessarily) different from each other, and entering the guides 161, the desired colored or textured yarn or tape may show on the front 113 or back 115 of the fabric or textile 101 by virtue of one or more twists 127. A non-controlled twisting means may be used by engaging the twister 151 without controls, which would allow for expression of the color or texture at substantially random intervals.

In addition, as shown in FIG. 3B, the non-controlled twisting means may take advantage of inherent characteristics of the textile production process. In various embodiments, using the disclosed method and filaments in the normal operation of a commercial textile machine 105 may lead to certain filaments being twisted. Having the uncontrolled twisting inherent in the operation of a commercial textile machine (e.g. in the configuration and method illustrated in FIG. 3B, for example) a relatively random pattern of expression of colors (first color 107, second color 109, third color 110) may be achieved on the surface of a fabric or textile 101.

A twister 151 controlled by a servo 153 may provide for pre-programmed motions, which in various embodiments is instructed by a special software 157 provided on a computer 145 or like processing unit. At appropriate intervals to interact with the machine 105 or textile-production process (for example, between groups of three or four yarns 129 or tapes 131), a servo motor 153 (or other appropriate moving mechanism) may be provided by mounting on the machine or a freestanding frame, and may have connection rods 155 (or other electronic communication mechanism including by mechanical or wireless transmission) to each twister 151. In various embodiments, one servo 153 may control multiple twisters 151. The servo-controlled twisting device or twister 151 may further comprise synchronizing means (or speed) with the machines 105 that are looping, weaving, or laminating the yarns or tapes (filaments 103) to produce the correct designed material 101. In various embodiments, the finished fabric may be wound on a winder 191. In greater detail, the connection between the servo motor 153 to the twister 151 involves electronic communication means. The twister 151 may take the form of any appropriate shape, including, but not limited to, a circle with holes, a flat shape, tube, hooks, or other shape. In various embodiments, the twister 151 has apertures for accepting the yarns 129 or tapes 131 (filaments 103) to be twisted. All three filaments 103 may be provided through a same needle 163 in the commercial textile-production machine 105.

The twister 151 may be able to rotate or pivot using any known appropriate rotational mechanical components, for example, an axle. If mounted, the twister may be mounted using any appropriate means, including clamps, screws, bolts, or other suitable mechanism. If freestanding, any appropriate supporting device or mechanism can be used, for example, a stand. Similarly, the servo may be attached to the system using mounting or supporting mechanisms. The communication between the servo and twisting device may be a one-to-many ratio, as may be appropriate. Though the connection may require electronic communication components, necessary cabling, wiring, etc. and supporting structure should be contemplated as within the scope of this disclosure. Similarly, communication between the servo and computerized logic component should be understood to include cabling, wiring, etc. and any accompanying supporting structure such as tubing. It should likewise be understood that there may be multiple logic pieces in lieu of a single centralized logic component. This may allow for distributed computing at the point of the servo. In various embodiments the electronic communication may be made wirelessly.

For example, the separator 141 may provide to the twister 151 three filaments 103 (yarns 129/tapes 131), all having a different color (first color 107, second color 109, third color 110). In this example, one is green, another red, and another blue. The servo 153 instructions 157 may call for a 120 degree rotation of the twister 151, changing the color expression on the fabric surface, for example, from red to blue. Another instruction 157 may cause the servo 151 to rotate the twister 151 another 120 degrees from blue to green for some time. Finally, the servo 153 may rotate the twister 151 backwards 120 degrees, causing blue to express again. The result is a fabric 101 having a section which is blue, then green, then back to blue. In various embodiments, the back side of the fabric may, for example, show red, then blue, then red again. In other words, a first side of a fabric 113 may be the opposite of a second side of a fabric 115. To that end, a similar pattern is provided on the back side of the fabric 115 in a different color. In a woven 135 or tightly-knitted 133 fabric, this may create a two-dimensional or two-sided image fabric; in a looser-knit 133 fabric this may create a three-dimensional or three-sided image fabric where loose yarn or loose loops are used. It should be understood that various tape or yarn types can be used for each tape or yarn in a group, including materials having particular attributes. For example, two non-reflective and two reflective filaments can be formed to create a particular pattern using the system and method disclosed based on the material types.

In FIG. 3A and FIG. 3B, the twisted filaments 103 are provided into a commercial textile production machine 105, producing knitted 133, woven 135, and laminated 137 fabrics 101 having a variable color expression. As a non-limiting example, the knitted 133, woven 135, and laminated 137 fabrics 101 have a first color 107, second color 109, and third color 110.

Twisted yarns or tapes may interact with a typical knitted fabric 133. For example, a warp-knitting process using a single guide bar may allow for use of twisted yarns 129 or tapes 131 (filaments 103) on either the warp 123 or weft 125. As another example, a known warp and weft-knitting process requiring two guide bars may use the disclosed system and method herein. Knitting using the disclosed system and method may include creating fabric by transforming continuous twisted strands of yarns (filaments 103) to a series of interlocking (2) loops. As seen in FIGS. 3A and 3B the knitted 133 fabric 101 includes a loop which hangs by the one immediately preceding it. The basic element of the structure is the loop intermeshed with the loops adjacent to it on both sides and above and below the loop. A knit fabric structure intermeshed with weft and warp loops on both sides may provide increased stability and options regarding patterns.

Figure 4A:
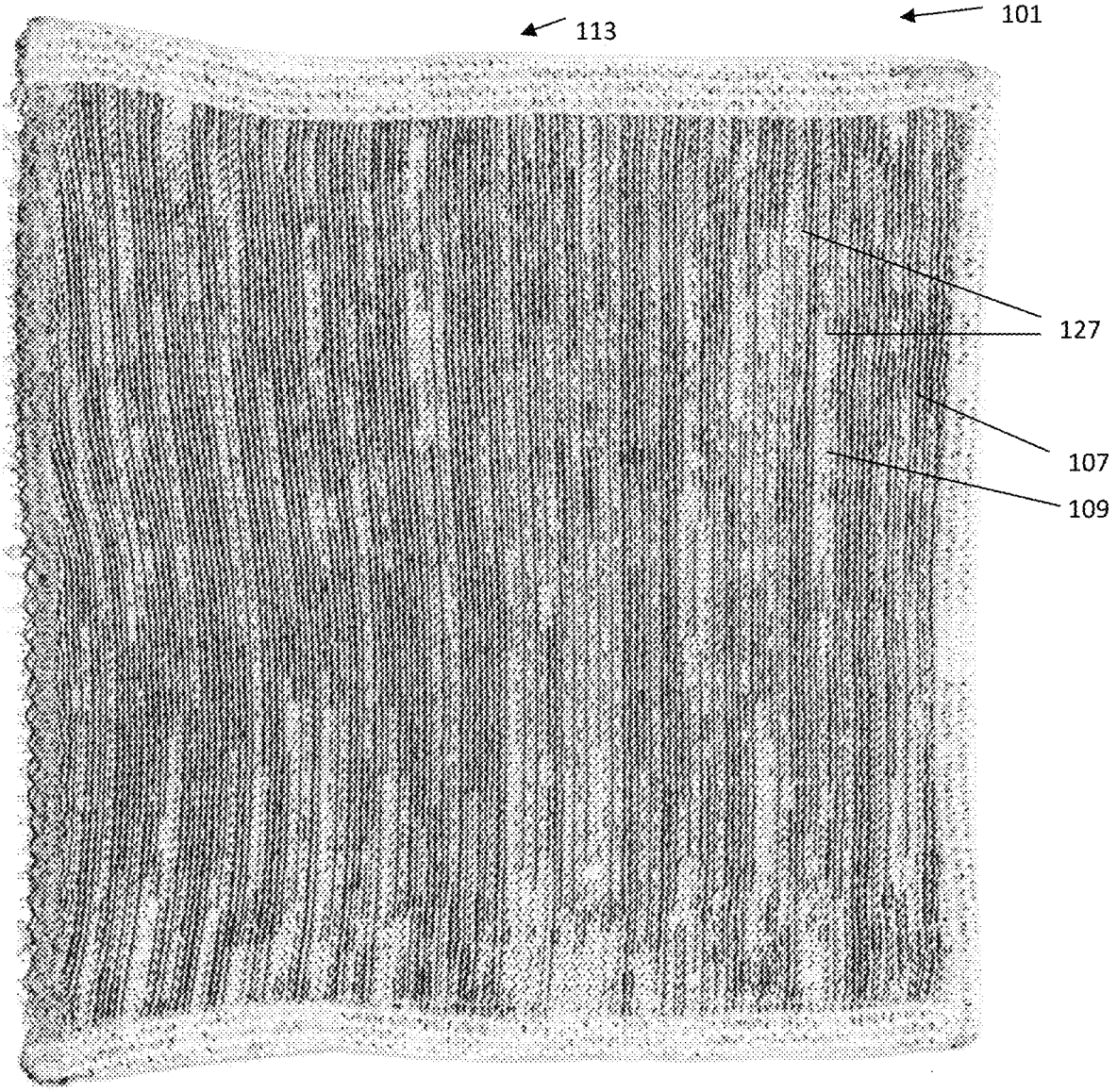
FIG. 4A shows a first side of a textile produced by the system and method herein, according to various embodiments.
Figure 4B:
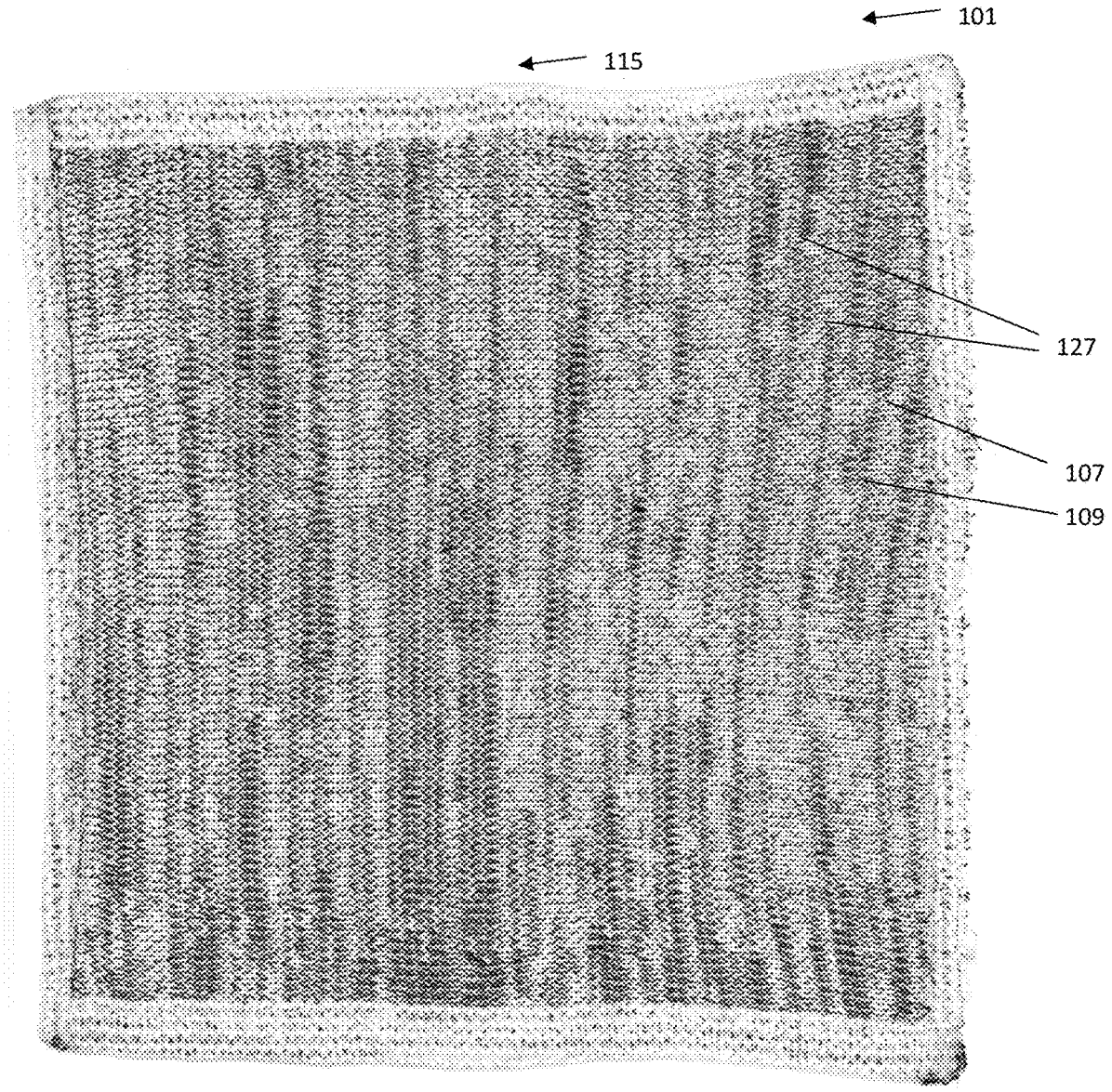
FIG. 4B shows a second side of the textile of 4A produced by the system and method herein, according to various embodiments.

FIGS. 4A and 4B show a first side 113 (FIG. 4A) and second side 115 (FIG. 4B) of a textile 101 produced using the system and method herein. As can be seen, the textile provides for expression of two colors 107, 109 by way of a number of twists 127. The difference in pattern expression on the first side 113 and second side 115 of the fabric (comparing FIG. 4A to FIG. 4B) can be seen to be somewhat opposite in expression. For instance, the expression of the first (darker) color 107 is seen more frequently (more heavily expressed) on the front 113 of the textile than the back 115 which has heavier expression of the second 109 (lighter) color.

Figure 5A:
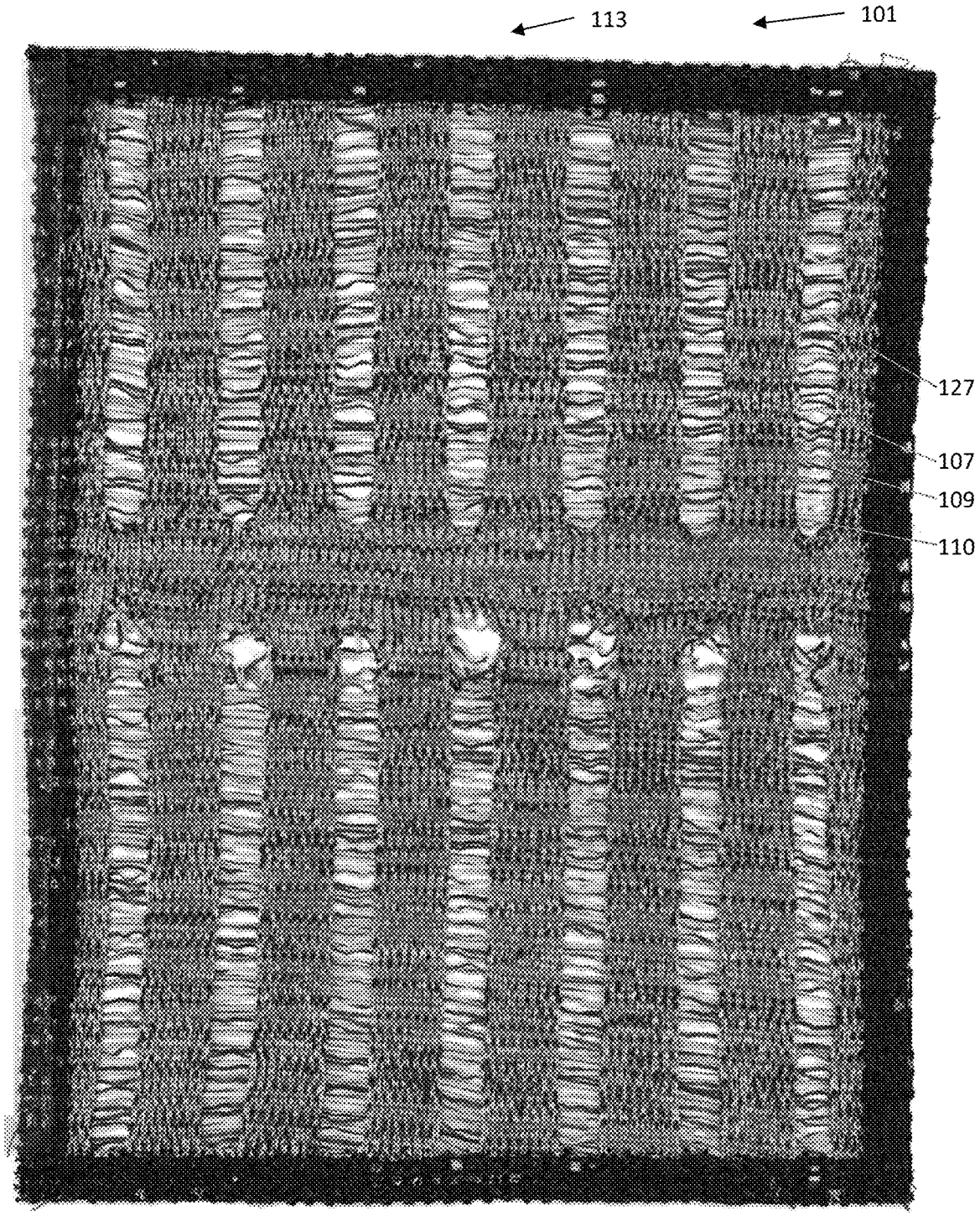
FIG. 5A shows a first side of a textile produced by the system and method herein, according to various embodiments.
Figure 5B:
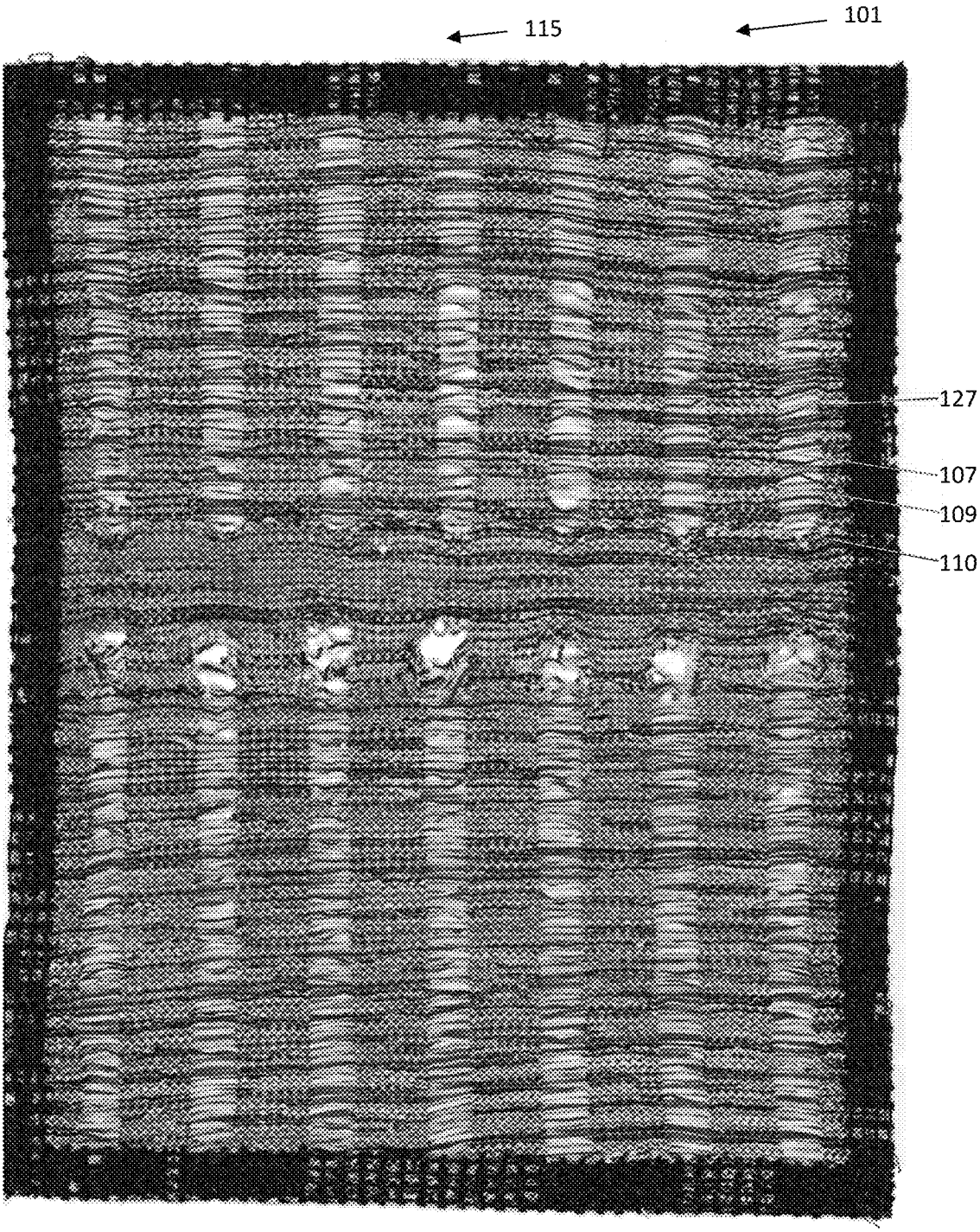
FIG. 5B shows a second side of the textile of 5A produced by the system and method herein, according to various embodiments.

Similarly, FIGS. 5A and 5B show a front 113 (FIG. 5A) and back 115 (FIG. 5B) of a textile 101. The textile 101 includes a first color 107, second color 109, and third color 110. The expression of these colors is altered by a number of twists 127. The plurality of colors (107, 109, 110) may be understood as occurring on the warp 123 and weft 125 or both.

Figure 6:
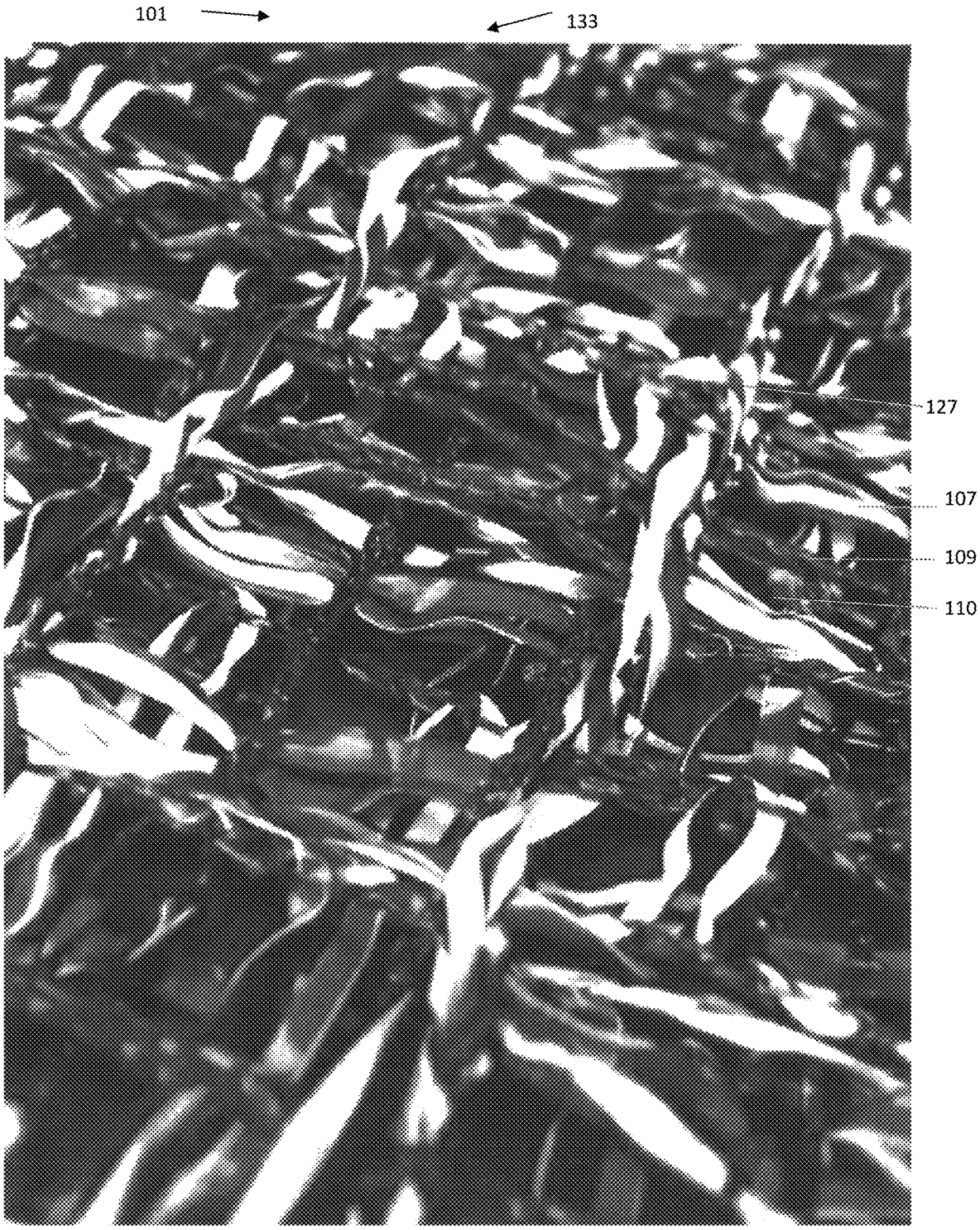
FIG. 6 shows a knitted fabric produced by the system and method disclosed herein, according to various embodiments.

FIG. 6 specifically shows the expression of differing colors using a knitting process 133 employing the twisting system or method disclosed to produce a textile 101. As can be easily seen, the color expression is varied. Filaments 103 comprising a first color 107, second color 109, and third color 110 can all be seen. The twists 127 can be seen to lead to expression of differing colors on the surface of the fabric 101.

Figure 7:
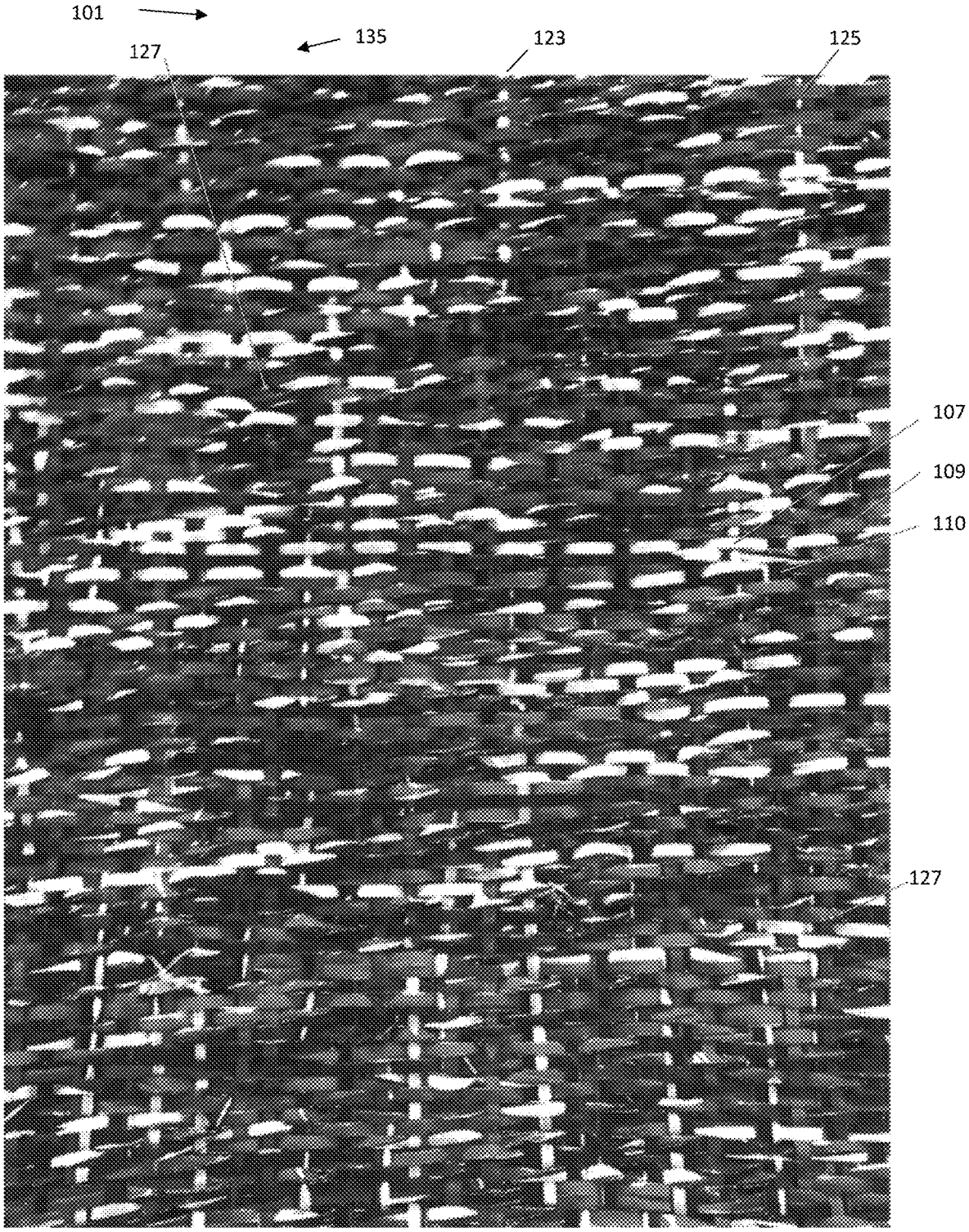
FIG. 7 shows a woven fabric produced by the system and method disclosed herein, according to various embodiments.

FIG. 7 discloses details regarding the use of the system or method disclosed in the context of a weaving process (woven fabric 135) to produce a textile 101 having variable color expression. FIG. 7 shows multiple twisted tapes or yarns (filaments 103) supplied to either the warp 123 or weft 125 for expression of color (107, 109, 110) on the surface of the fabric 110 in the context of an illustrated typical woven fabric. As can be seen, the resulting color expression is varied across the fabric sample disclosed as a result of a number of twists 127.

Figure 8:
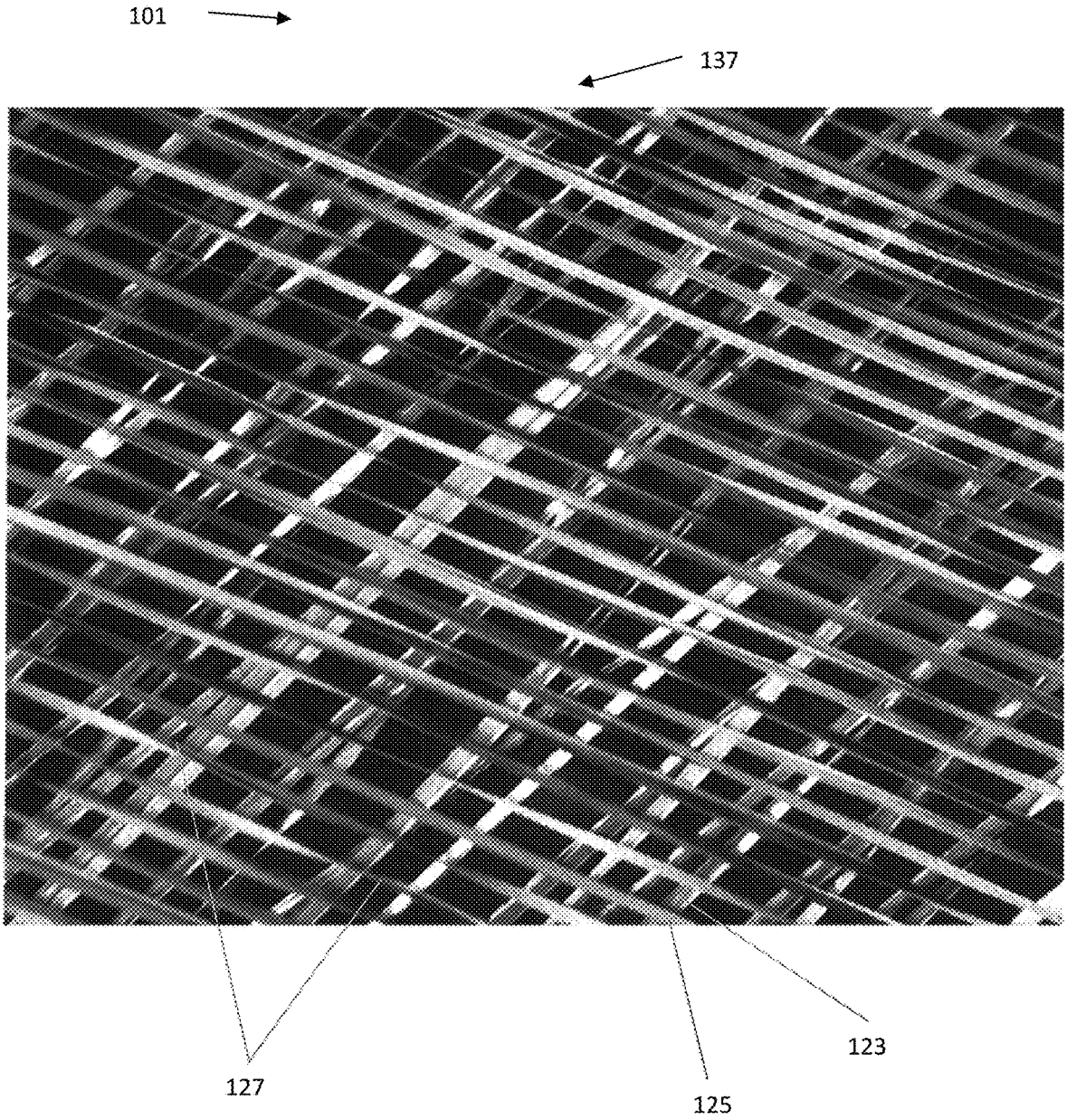
FIG. 8 shows a laminated fabric produced by the system and method disclosed herein, according to various embodiments.

Similarly, FIG. 8 discloses details regarding the use of the system or method disclosed in the context of a laminated textile process (laminated fabric 137), by illustrating how twisted 127 tapes or yarns of varying color may enter a typical laminated textile 101. FIG. 7 specifically shows the provision of multiple twisted warp filaments 123 or weft filaments 125 for varied expression of color (or, in various embodiments, texture) across a laminated textile 137.

Of particular relevance in the laminating process is that the number of tapes can be limited by the use of dual-extruded dual-colored slit tapes. In various embodiments, a film could be used, for example a 30 inch film, could be sent to a printer and different colors could be printed and slit to create colors on each tape to create a variable-expression fabric.

Figure 9:
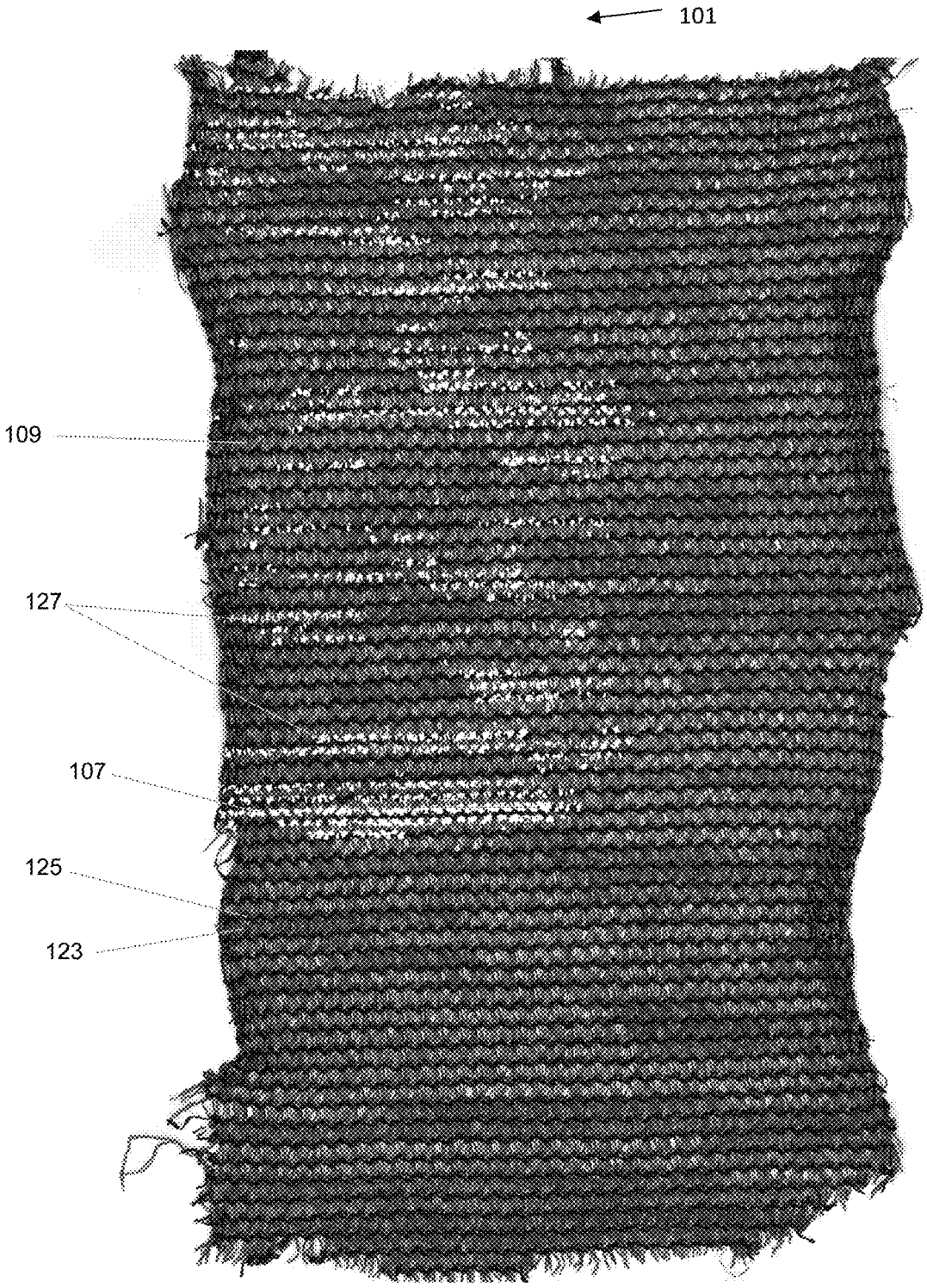
FIG. 9 shows a fabric produced by the system and method disclosed herein, according to various embodiments.

FIG. 9 shows a textile 101 produced by a coextruded filament having a first side with a first color 107 and second side having a second color 109. The warp 123 shows the color variance while the weft 125 filament is solid. A number of twists 127 vary the expression of the colors 109, 107.

As indicated, the methods, systems, and devices described herein may be implemented in part by software. To this end, the methods, systems, and devices may be implemented in a general purpose software package. In one or more examples of embodiments the method, system, or device, or such method, system, or device embodied by software, may be implemented by a computer system or in combination with a computer system. The computing system may also be a known computing system suitable for interaction with textile production systems.

The computer system may be or include a processor. The computers for use with the methods and various components described herein may be programmable computers which may be special purpose computers or general purpose computers that execute the system according to the relevant instructions. The computer system can be an embedded system, a personal computer, notebook computer, tablet computer, server computer, mainframe, networked computer, handheld computer, personal digital assistant, workstation, and the like. Other computer system configurations may also be acceptable including, cell phones, mobile devices, multiprocessor systems, microprocessor-based or programmable electronics, network PC's, minicomputers, and the like. Preferably, the computing system chosen includes a processor suitable in size to efficiently operate one or more of the various systems, devices, or functions.

The system or portions thereof as described herein may be linked to a distributed computing environment, where tasks are performed by remote processing devices that are linked through a communications network. To this end, the system may be configured or linked to multiple computers in a network, including, but not limited to a local area network, a wide area network, a wireless network, and the Internet. Accordingly, information and data is transferred within the network or system by wireless means. Such wireless means include any now known or future developed system, examples of which include Wi-Fi, Bluetooth, GPRS, RF, and cellular data systems. It is also contemplated that certain aspects of the system may be implemented through hardwire connection, such as computer to computer communication.

The computer can also include a display, provision for data input and output, etc. Furthermore, the computer or computers may be operatively or functionally connected to one or more mass storage devices, such as, but not limited to a database or cloud storage medium. The memory storage can be volatile or non-volatile and can include removable storage media. The system may also include computer-readable media which may include any computer readable media or medium that may be used to carry or store desired program code that may be accessed by a computer. The invention can also be embodied as computer readable code on a computer readable medium. To this end, the computer readable medium may be any data storage device that can store data which can be thereafter read by a computer system. Examples of computer readable medium include read-only memory, random-access memory, CD-ROM, CD-R, CD-RW, magnetic tapes, and other optical data storage devices. The computer readable medium can also be distributed over a network coupled computer system so that the computer readable code is stored and executed in a distributed fashion.

These devices may include a graphical user interface (GUI) or a communication means by which commands may be entered and content may be displayed or communicated. For example, the computer may include a user interface that allows navigation of objects. The computer may implement or include an application that enables a user to display and interact with text, images, videos, data, and other information and content.

Aspects of the method, system, and devices described herein can be implemented on software running on a computer system. The system or method herein, therefore, may be operated by computer-executable instructions, such as but not limited to program modules, executable on a computer. Examples of program modules include, but are not limited to, routines, programs, objects, components, data structures and the like which perform particular tasks or implement particular instructions. The software system may also be operable for supporting the transfer of information within a network.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom") in this description are merely used to identify various elements as are oriented in the Figures. It should be recognized that the orientation of particular components may vary greatly depending on the application in which they are used.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is also important to note that the construction and arrangement of the system, methods, and devices as shown in the various examples of embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g. by variations in the number of engagement slots or size of the engagement slots or type of engagement). The order or sequence of any process or method steps may be varied or re-sequenced according to alternative embodiments. Other substitutions, modifications, changes and omissions may be made in the design, operating conditions and arrangement of the various examples of embodiments without departing from the spirit or scope of the present inventions.

Moreover, some portions of the detailed descriptions herein are presented in terms of procedures, steps, logic blocks, processing, and other symbolic representations of operations on data bits that can be performed on computer memory. These descriptions and representations are the means used by those skilled in the data processing arts to most effectively convey the substance of their work to others skilled in the art. A procedure, computer executed step, logic block, process, etc., is here, and generally, conceived to be a self-consistent sequence of steps or instructions leading to a desired result. The steps are those requiring physical manipulations of physical quantities. Usually, though not necessarily, these quantities take the form of electrical or magnetic signals capable of being stored, transferred, combined, compared, and otherwise manipulated in a computer system. It should be borne in mind, however, that all of these and similar terms are to be associated with the appropriate physical quantities and are merely convenient labels applied to these quantities. Unless specifically stated otherwise as apparent from the discussions herein, it is appreciated that throughout the present invention, discussions utilizing terms such as "receiving," "sending," "generating," "reading," "invoking," "selecting," and the like, refer to the action and processes of a computer system, or similar electronic computing device, including an embedded system, that manipulates and transforms data represented as physical (electronic) quantities within the computer system.

While this invention has been described in conjunction with the examples of embodiments outlined above, various alternatives, modifications, variations, improvements and/or substantial equivalents, whether known or that are or may be presently foreseen, may become apparent to those having at least ordinary skill in the art. Accordingly, the examples of embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements and/or substantial equivalents.

The technical effects and technical problems in the specification are exemplary and are not limiting. It should be noted that the embodiments described in the specification may have other technical effects and can solve other technical problems.

What is claimed is:

1. A method of producing a variable-color textile fabric, the method comprising:

providing a plurality of filaments into a commercial textile production machine, wherein at least a one of the plurality of filaments is a tape of film having a first color on a first side of said tape and a second color on a second side of said tape; directing the at least said one filament through a single guide such that as said at least one filament is randomly engaged and twisted by the tools of the machine in the production process the said first and second colors of the sides of the tape will be randomly presented to the surfaces of each side of the textile fabric to display said first and second colors in a randomly repeated manner.

2. The method of claim 1, wherein at least two of said plurality of filaments comprise tapes of film having selected different colors on opposite sides of said filaments which are twisted by the tools of the machine in the production process to randomly display said selected different colors on the surfaces of both sides of the textile fabric.

3. The method of claim 1, wherein twisting of the tapes is performed by a twister prior to directing the at least one filament through said single guide.

4. The method of claim 3, wherein the twister is controlled by a computer.

5. A method of producing a randomly variable-color textile fabric, the method comprising: providing a multiple number of filaments into a commercial textile-production machine, wherein at least a first plurality of said filaments include at least one tape of coextruded film having a first color on a first side of said tape and a second color on a second side of said tape, directing said first plurality of said filaments through a single guide such that as said first plurality of said filaments are randomly engaged and twisted by the tools of the machine in the production process the colors on the two sides of said at least one filament tape will be randomly presented to the surfaces of each side of the textile fabric whereby both sides of the fabric will display said first and second colors in a randomly repeated manner.

6. The method of producing a randomly variable-color textile fabric of claim 5, wherein at least a second plurality of said filaments include at least one tape of coextruded film having a third color on one side of said at least one tape and a fourth color on an opposite side thereof, wherein as said first and second pluralities of filaments are respectively directed through said single guides and randomly engaged and twisted by the tools of the machine in the production process the colors of the two sides of said at least one tapes of said first and second pluralities of said filaments will be randomly presented to the surfaces of each side of the textile fabric whereby both sides of the fabric will display the said first, second, third and fourth colors in a randomly repeated manner.

7. The method of producing a randomly variable-color textile fabric of claim 6, wherein said at least first and second pluralities of said filaments each include a third plurality of filaments selected from at least one of the group of filaments consisting of thread, yarn, and plastic monofilament.

8. The method of claim 7, wherein said third plurality of filaments are of a plurality of selected colors.

9. A method of producing a randomly variable-color textile fabric, the method comprising: providing pluralities of filaments into a commercial textile production machine, the pluralities of filaments including at least two different colored extruded tapes of a width to effectively display their distinct colors when positioned on the surface of a fabric, directing selected pluralities of said tapes through single guides such that as the tapes are individually randomly engaged and twisted by the tools of the machine in the production process two different colors of the plurality of filaments will be randomly provided on each side of the textile fabric to display its colors in a randomly repeated manner.

10. The method of claim 9, wherein at least one of the filaments of the plurality of different colored filaments is a tape of coextruded film having a first color on a first side of said tape and a second color on a second side of said tape, whereby the plurality of filaments will randomly display at least three colors on each side of the textile fabric.

11. The method of claim 9 wherein each of the plurality of colored filaments is a tape of coextruded film having a selected first color on a first side of the tape and a selected second color on a second side of the tape whereby each said plurality of colored filaments can randomly display twice as many colors as its number of tapes on each side of the textile fabric.

12. The method of claim 9 further comprising;

providing a plurality of different colored filaments of a width to effectively display their colors when positioned on the surface of a fabric into said commercial textile production machine, the plurality of filaments each being separately directed as a one of a composite warp or composite weft through a single guide of the machine such that as the composite plurality of different colored filaments are randomly engaged and twisted by the tools of the machine in the production process each of the composite warp and weft filaments will be randomly presented to the surfaces of each side of the resulting fabric to display its color in a randomly repeated manner.

13. The method of claim 12, wherein one or more of the plurality of filaments is a coextruded tape having two sides of different colors such that as each of said coextruded two color tapes are randomly engaged and twisted by the tools of the machine in the fabricating process each of the two colors will be randomly displayed on both sides of the resulting fabric.

14. The method of claim 1, wherein the at least one of a plurality of filaments is a tape slit from a sheet of coextruded polyethylene laminar film having a first sheet with a first color expressed on a first side surface of said film and a second sheet having a second color expressed on an opposite second side surface of said film.

15. The method of claim 14, wherein the sheet of coextruded polyethylene laminar film from which the tape is slit has a third center sheet having a third color provided between the first side sheet and the second side sheet.

16. The method of claim 15 wherein the said third center sheet of said coextruded laminar film has an extruded film thickness of approximately 40 to 60 microns, and the said first and second side sheets of said coextruded laminar film have an extruded polyethylene sheet thickness of approximately 10 to 20 microns each, whereby the entire coextruded laminar film may be approximately 50-100 microns in thickness, and wherein the coextruded film sheets can be slit to form tapes of a desired width, which tapes can be stretched to a much thinner selected filament width and thickness for the resulting textile fabric.

17. The method of claim 15 wherein the said third center sheet of said coextruded laminar film has an extruded film thickness of approximately 50-55 microns, and the said first and second side sheets of said coextruded laminar film have an extruded polyethylene sheet thickness of approximately 14-16 microns each, whereby the entire coextruded film may be approximately 75-85 microns in thickness, and wherein the coextruded film sheets can be slit to form tapes of a desired width, which tapes can be stretched to a thinner selected filament width and thickness for the resulting textile fabric.

* * * * *